US010801505B2

(12) United States Patent
Yoko et al.

(10) Patent No.: US 10,801,505 B2
(45) Date of Patent: Oct. 13, 2020

(54) ROTARY MACHINE

(71) Applicant: MITSUBISHI HEAVY INDUSTRIES COMPRESSOR CORPORATION, Tokyo (JP)

(72) Inventors: Kazutoshi Yoko, Tokyo (JP); Shin Yanagisawa, Tokyo (JP); Eiichi Yanagisawa, Tokyo (JP); Akihiro Nakaniwa, Tokyo (JP); Daisuke Hirata, Hiroshima (JP); Takanori Matsueda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 176 days.

(21) Appl. No.: 16/077,162

(22) PCT Filed: Dec. 8, 2016

(86) PCT No.: PCT/JP2016/005085
§ 371 (c)(1),
(2) Date: Aug. 10, 2018

(87) PCT Pub. No.: WO2017/168479
PCT Pub. Date: Oct. 5, 2017

(65) Prior Publication Data

US 2019/0048877 A1 Feb. 14, 2019

(30) Foreign Application Priority Data

Mar. 28, 2016 (JP) ..... 2016-063780

(51) Int. Cl.
*F04D 17/12* (2006.01)
*F04D 29/70* (2006.01)
(Continued)

(52) U.S. Cl.
CPC ..... *F04D 17/12* (2013.01); *F04D 17/122* (2013.01); *F04D 29/42* (2013.01);
(Continued)

(58) Field of Classification Search
CPC ..... F04D 17/12; F04D 17/122; F04D 17/125; F04D 29/42; F04D 29/4206; F04D 29/58;
(Continued)

(56) References Cited

U.S. PATENT DOCUMENTS 2,604,257 A * 7/1952 Haeberlein ..... F04D 29/057 415/112
4,046,155 A * 9/1977 Mansson ..... B08B 3/02 134/167 R
(Continued)

FOREIGN PATENT DOCUMENTS

GB 1 381 904 A 1/1975
JP 57206800 A * 12/1982 ..... F04D 17/12
(Continued)

OTHER PUBLICATIONS

International Search Report for corresponding International Application No. PCT/JP2016/005085, dated Feb. 14, 2017 (4 pages).
(Continued)

*Primary Examiner* — Moshe Wilensky
*Assistant Examiner* — Joshua R Beebe
(74) *Attorney, Agent, or Firm* — Osha Liang LLP

(57) ABSTRACT

A centrifugal compressor according to the present invention includes, as gas flow paths, diffuser flow paths into which process gas flowing from impellers to outside in a radial direction flows, curved flow paths that respectively communicate with the diffuser flow paths and change a flowing direction of the process gas from a direction toward the outside in the radial direction to a direction toward inside in the radial direction, and return flow paths that respectively
(Continued)

communicate with the curved flow paths and cause the process gas flowing through the curved flow paths to flow into the impellers. In the present invention, the curved flow path configuring at least one of the gas flow paths is provided between a diaphragm and a flow path forming body that is provided between the diaphragm and the casing.

9 Claims, 3 Drawing Sheets

(51) Int. Cl.
*F04D 29/42* (2006.01)
*F04D 29/58* (2006.01)

(52) U.S. Cl.
CPC ..... *F04D 29/4206* (2013.01); *F04D 29/58* (2013.01); *F04D 29/5846* (2013.01); *F04D 29/705* (2013.01)

(58) Field of Classification Search
CPC ..... F04D 29/5846; F04D 29/705; F01D 1/06; F01D 1/02
See application file for complete search history.

(56) References Cited

U.S. PATENT DOCUMENTS 4,571,151 A * 2/1986 Paul ..... F04D 29/5846 415/1
4,579,509 A 4/1986 Jacobi
4,770,606 A 9/1988 Kuroiwa
2007/0183892 A1* 8/2007 Sorokes ..... F04D 17/125 415/214.1
2015/0043848 A1* 2/2015 Grosso ..... F04D 29/04 384/316

FOREIGN PATENT DOCUMENTS

JP S62-203997 A 9/1987
JP H01-076598 U 5/1989
JP H08-338397 A 12/1996
JP H09-004599 A 1/1997
JP H11-270499 A 10/1999
JP 2001-254697 A 9/2001
JP 2005-351185 A 12/2005
JP 2007-032297 A 2/2007
JP 2012-002169 A 1/2012
JP 2013-249771 A 12/2013
WO WO-2014187786 A2 * 11/2014 ..... F01D 25/145

OTHER PUBLICATIONS

International Preliminary Report on Patentability for corresponding International Application No. PCT/JP2016/005085, dated Oct. 11, 2018 (9 pages).
Extended European Search Report in counterpart European Application No. 16896699.2 dated Feb. 5, 2019 (7 pages).

* cited by examiner

ROTARY MACHINE

TECHNICAL FIELD

The present invention relates to a rotary machine that moderates temperature distribution in a casing, such as a centrifugal compressor.

BACKGROUND ART

A centrifugal compressor sucks in process gas as a compression target, raises pressure of the process gas to a desired pressure, and then supplies the resultant process gas to a next process. For example, a centrifugal compressor for a nitric acid plant sucks in process gas at about 50° C.; however, the temperature of the process gas is raised to about 200° C. along with the pressure rise.

At this time, in the centrifugal compressor in which flanges of two divided casings are fastened by bolts, thermal deformation occurs due to temperature difference from an outlet of the process gas to a bearing, in addition to temperature difference from an inlet of the process gas to the outlet. As a result, division surfaces of the two divided casings may be separated and the process gas may accordingly flow out of the casings.

In addition, in the centrifugal compressor, cleaning water is injected in order to clean the inside of the centrifugal compressor during operation in some cases. The casing is rapidly cooled by the cleaning water supplied by the water injection, and the temperature distribution inside the casing is unsteadily varied. As a result, a steep temperature difference occurs in a thickness direction of the casing, and thermal deformation that causes separation occurs around the division surfaces due to the temperature difference.

Patent Literature 1 proposes means for suppressing leakage of high-pressure gas from the division surfaces. Patent Literature 1 discloses a horizontal flange that includes a linear portion (2a) extending along a body part (10a), a curved portion (2b) extending along a curved surface part (10b), and a crest neighboring portion (2c) near a crest part (10c). Further, Patent Literature 1 discloses that a curved-portion bolt interval (L2) of the curved portion (2b) of the horizontal flange is made larger than a linear-portion bolt interval (L1) of the linear portion (2a) and a crest-part bolt interval (L3) of the crest neighboring portion (2c). According to Patent Literature 1, it is possible to suppress a reduction amount of surface pressure at the crest neighboring portion (2c) and to suppress separation of the crest neighboring portion (2c).

CITATION LIST

Patent Literature

Patent Literature 1: JP 2013-249771 A

SUMMARY OF INVENTION

Technical Problem

In Patent Literature 1, however, no consideration is given to leakage of the process gas from the division surfaces caused by the temperature difference occurring on the centrifugal compressor.

Accordingly, an object of the present invention is to provide a rotary machine, typically, a centrifugal compressor that moderates temperature differences occurring in a casing to reduce separation of division surfaces.

Solution to Problem

A rotary machine according to the present invention includes a casing, a rotor that includes a rotary shaft rotatably supported inside the casing and a plurality of stages of impellers fixed to an outer periphery of the rotary shaft, diaphragms respectively surrounding the impellers, and gas flow paths through which process gas to be compressed flows. The gas flow paths are provided corresponding to the impellers.

The gas flow paths according to the present invention include diffuser flow paths into which the process gas flowing out from the impellers to outside in a radial direction flows, curved flow paths that respectively communicate with the diffuser flow paths and change a flowing direction of the process gas from a direction toward the outside in the radial direction to a direction toward inside in the radial direction, and return flow paths that respectively communicate with the curved flow paths and cause the process gas flowing through the curved flow paths, to flow into the impellers.

Further, in the rotary machine according to the present invention, the curved flow path configuring at least one of the gas flow paths is provided between the diaphragm and a flow path forming body that is provided between the diaphragm and the casing.

In the rotary machine according to the present invention, the casing preferably includes an annular accommodating groove recessed outward in the radial direction, corresponding to a region provided with the flow path forming body, and the flow path forming body preferably includes an annular shape and is mated with the accommodating groove.

In the rotary machine according to the present invention, the flow path forming body is preferably positioned based on one or both of temperature of the process gas and a range where water injection is performed.

In the rotary machine according to the present invention, the curved flow path configuring the gas flow path located in at least a last stage, out of the gas flow paths, is preferably provided between the corresponding diaphragm and the flow path forming body.

In addition, the curved flow paths configuring the gas flow paths located in all stages within the range where the water injection is performed, out of the gas flow paths, are preferably provided between the diaphragms and the flow path forming body.

Further, in the rotary machine according to the present invention, the curved flow path configuring the gas flow path located in a rear stage within the range where the water injection is performed, out of the gas flow paths, is preferably provided between the corresponding diaphragm and the flow path forming body.

In the rotary machine according to the present invention, the flow path forming body preferably includes flow paths corresponding to the curved flow paths.

In the rotary machine according to the present invention, in a case where the casing is a horizontal divisional casing including a lower half casing and an upper half casing, the curved flow paths provided between the diaphragms and the flow path forming body may be provided on one or both of the lower half casing and the upper half casing.

In the rotary machine according to the present invention, the curved flow paths other than the curved flow paths provided between the diaphragms and the flow path forming body, are provided between the diaphragms and the casing in some cases.

In the rotary machine according to the present invention, the casing is preferably covered with a heat insulation material.

In addition, in a case where the casing includes paired bearings supporting the rotary shaft, bearing chambers respectively accommodating the bearings each preferably include a heat shielding material.

Advantageous Effects of Invention

According to the present invention, the flow path forming body as the internal component configures the curved flow paths, which provides a region where the process gas raised in temperature or the cleaning water does not come into direct contact with the casing. This makes it possible to avoid occurrence of steep temperature difference particularly at and around the division surfaces of the casing. Therefore, according to the rotary machine of the present invention, for example, the centrifugal compressor, it is possible to reduce thermal deformation of the casing and to suppress separation of the division surfaces. At the same time, thermal stress of the casing is moderated, which makes it possible to suppress occurrence of plastic deformation caused by the thermal stress, in the casing.

DESCRIPTION OF EMBODIMENTS

A centrifugal compressor 1 according to an embodiment of a rotary machine of the present invention is described with reference to FIG. 1 to FIG. 3.

Figure 1:
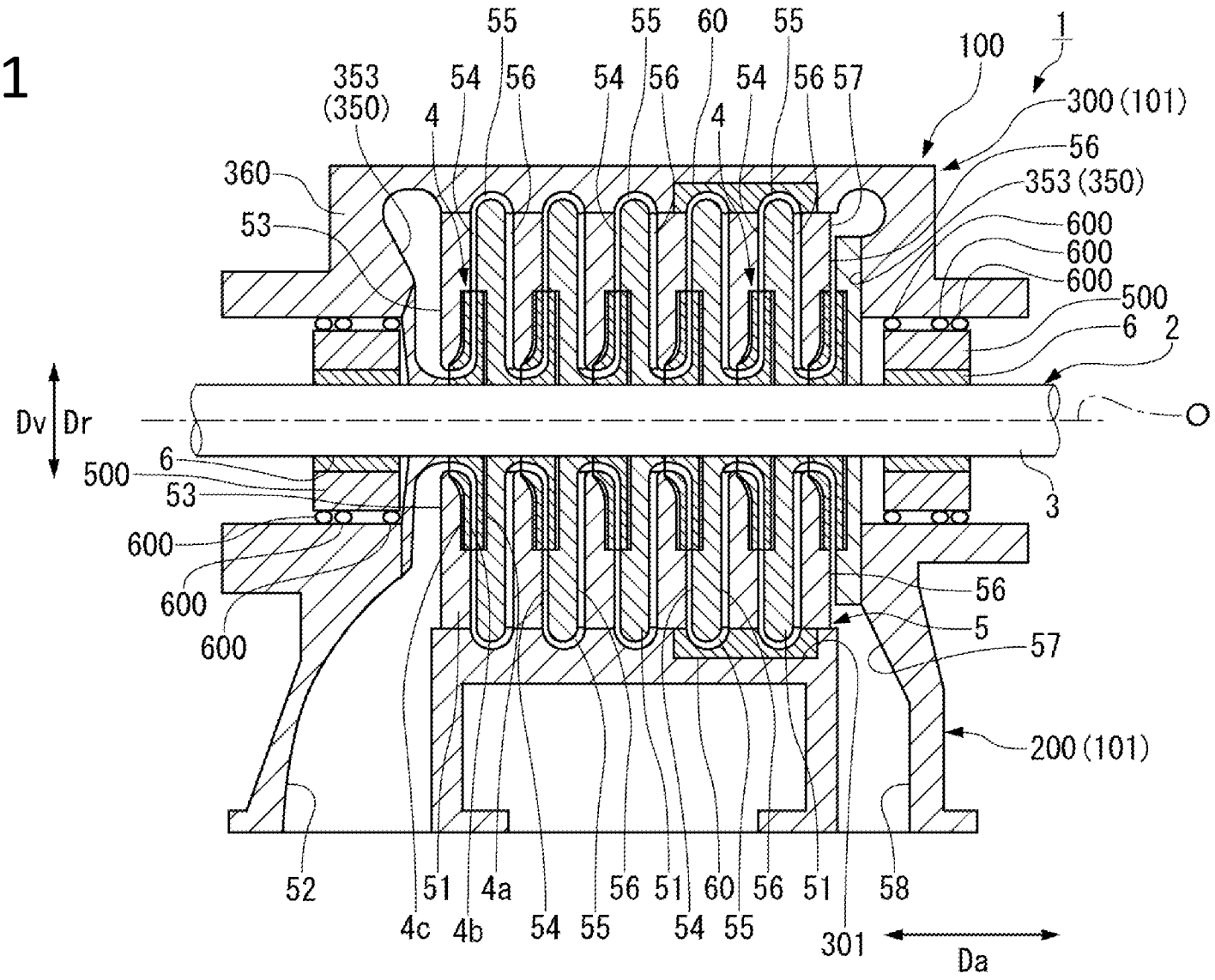
FIG. 1 is a vertical cross-sectional view illustrating a schematic configuration of a centrifugal compressor according to an embodiment of the present invention.

As illustrated in FIG. 1, the present embodiment relates to a uniaxial multistage centrifugal compressor 1 including a plurality of impellers 4. The centrifugal compressor 1 is characterized in that a part on rear stage side of a casing 101 is substituted by a flow path forming body 60 as an internal component, and the flow path forming body 60 configures curved flow paths 55 to moderate temperature differences occurring in the casing 101.

The centrifugal compressor 1 includes a rotor 2, a diaphragm group 5, a sealing device 6, and a casing assembly 100.

The rotor 2 rotates around an axis line O. The rotor 2 includes a rotary shaft 3 that extends along the axis line O and serves as a rotor main body, and the impellers 4 in the plurality of stages that rotate together with the rotary shaft 3.

The rotary shaft 3 is coupled to a driving source such as a motor and is rotationally driven by the driving source. The rotary shaft 3 includes a columnar shape around the axis line O, and extends in an axis line direction Da in which the axis line O extends. Both ends of the rotary shaft 3 in the axis line direction Da are rotatably supported by unillustrated bearings inside the casing 101.

The impellers 4 are fixed to an outer peripheral surface of the rotary shaft 3. The impellers 4 rotate together with the rotary shaft 3 to compress process gas as a compression target, with use of centrifugal force. The impellers 4 are provided in the plurality of stages in the axis line direction Da with respect to the rotary shaft 3. Each of the impellers 4 is a so-called closed impeller that includes a disk 4*a*, a blade 4*b*, and a cover 4*c*. A flow path through which the process gas flows is configured by the disk 4*a*, the blade 4*b*, and the cover 4*c* inside each of the impellers 4. The plurality of impellers 4 that are arranged along the axis line direction Da so as to face the same direction configure an impeller group.

The diaphragm group 5 surrounds the rotor 2 from outside. The diaphragm group 5 includes a plurality of diaphragms 51 that are arranged in the axis line direction Da, respectively corresponding to the impellers 4 in the plurality of stages. The plurality of diaphragms 51 are arranged so as to be stacked in the axis line direction Da. Each of the diaphragms 51 includes a space that can accommodate the corresponding impeller 4, inside in a radial direction Dr of the rotary shaft 3 that is a direction intersecting the axis line O. The diaphragms 51 are accommodated in the casing 101 while being mutually connected, to form flow paths through which the process gas flows, together with the flow paths of the impellers 4.

Here, the flow paths configured by the diaphragms 51 are specifically described in order from upstream side that is one side of the axis line direction Da. In the present embodiment, the diaphragm group 5 forms, in order from the upstream side through which the process gas flows, a suction port 52, a suction flow path 53, a plurality of diffuser flow paths 54, a plurality of curved flow paths 55, a plurality of return flow paths 56, a discharge flow path 57, and a discharge port 58. The diffuser flow paths 54, the curved flow paths 55, and the return flow paths 56 communicate with one another to configure the gas flow paths in the present invention.

The suction port 52 causes the process gas to flow into the suction flow path 53 from the outside. The suction port 52 causes the process gas that has flowed from the outside of the casing 101 described later, to flow into the diaphragm group 5. The suction port 52 is connected to the suction flow path 53 while an area of the flow path is gradually decreased from the outside in the radial direction Dr toward the inside in the radial direction Dr.

The suction flow path 53 causes, together with the suction port 52, the process gas to flow from the outside into the impeller 4 disposed on most upstream side out of the plurality of impellers 4 arranged in the axis line direction Da. The suction flow path 53 extends from the suction port 52 toward the inside in the radial direction Dr. The suction flow path 53 is connected to an inlet that faces the upstream side of the impeller 4 while a direction of the suction flow path 53 is gradually changed from the radial direction Dr to downstream side that is the other side of the axis line direction Da.

The process gas that has flowed out from the impellers 4 to the outside in the radial direction Dr flows into the diffuser flow paths 54. In other words, the gas flow paths are provided corresponding to the impellers 4. The diffuser flow paths 54 are respectively connected to outlets of the impellers 4 each facing the outside in the radial direction Dr. The diffuser flow paths 54 extend respectively from the outlets of the impellers 4 toward the outside in the radial direction Dr, and are respectively connected to the curved flow paths 55.

The curved flow paths 55 change a flowing direction of the process gas from a direction toward the outside in the radial direction Dr to a direction toward the inside in the radial direction Dr. In other words, as illustrated in FIG. 1, the curved flow paths 55 are flow paths each including a U-shaped vertical cross-section. The curved flow paths 55 are configured by an outer peripheral surface of the diaphragm group 5 and an inner peripheral surface of the casing 101. In other words, the curved flow paths 55 reach the casing 101, and the process gas flowing through the curved flow paths 55 comes into contact with the casing 101.

Figure 2:
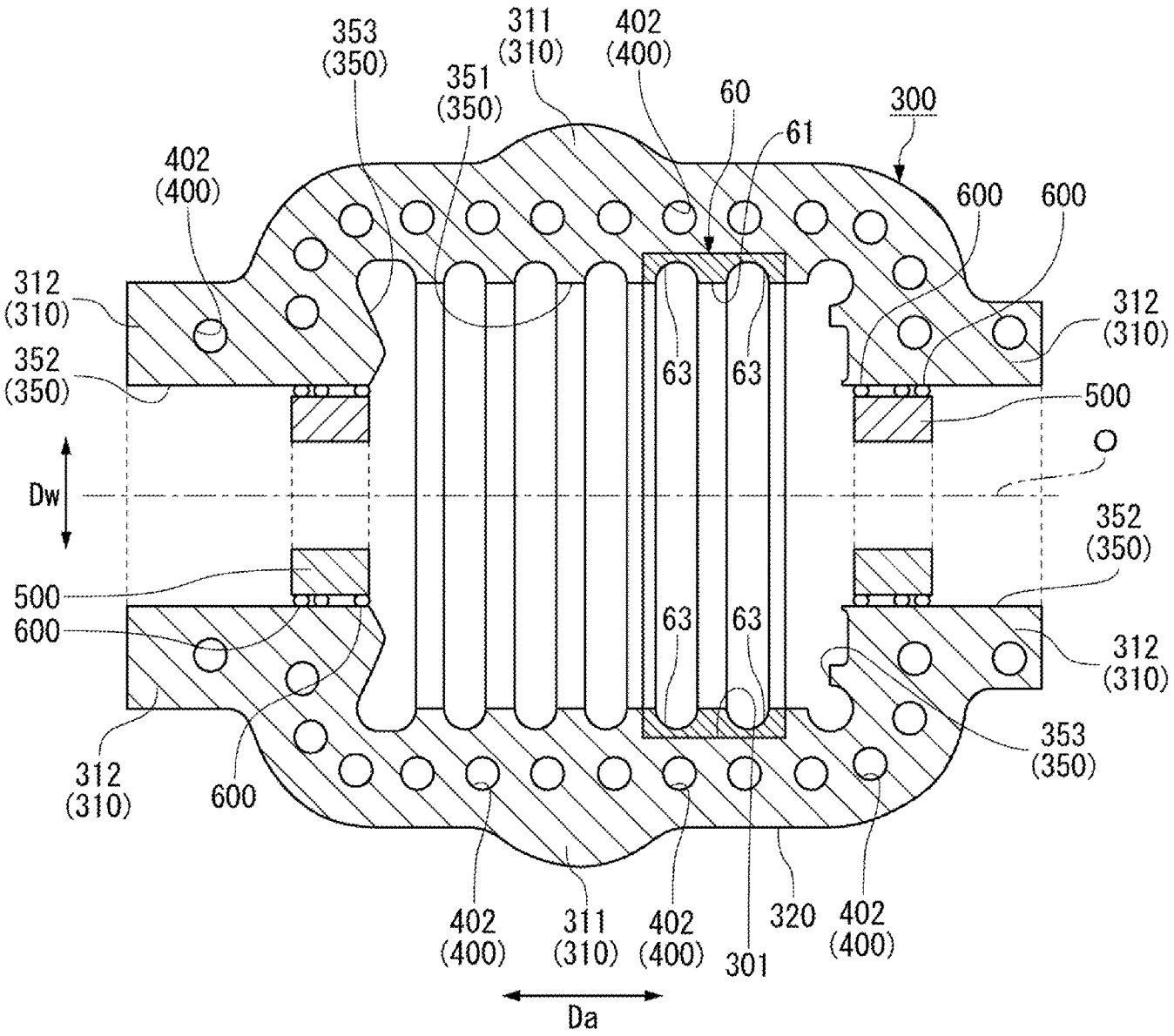
FIG. 2 is a diagram illustrating an upper half casing broken at a position near a shaft, according to the embodiment of the present invention.

As illustrated in FIG. 1 and FIG. 2, however, in the centrifugal compressor 1 according to the present embodiment, some of the curved flow paths 55 are configured by the outer peripheral surface of the diaphragm group 5 and an inner peripheral surface of the flow path forming body 60.

The flow path forming body 60 is provided for the curved flow path 55 in a last stage and the curved flow path 55 in a next-to-last stage. In the present embodiment, the flow path forming body 60 is involved in formation of the curved flow paths 55 in the last stage and in the next-to-last stage of both of a lower half casing 200 and an upper half casing 300 that configure the horizontal divisional casing 101.

The flow path forming body 60 is mated with an accommodating groove 301 that is formed in an annular shape on inner peripheral side of the upper half casing 300, so as to be a substitute for a part of the upper half casing 300. Note that the annular shape is a concept including a semi-annular shape.

The flow path forming body 60 includes an annular-shaped main body 61, and flow paths 63 and 63 that are recessed from an inner peripheral surface of the main body 61 toward an outer peripheral surface. The flow paths 63 and 63 are each formed in an annular shape to be continuous from one end to the other end in a circumferential direction on the inner peripheral surface of the main body 61.

Further, as illustrated in FIG. 1, the flow path forming body 60 is also provided in the lower half casing 200; however, the description thereof is omitted because the flow path forming body 60 provided in the lower half casing 200 includes the configuration same as that of the flow path forming body 60 provided in the upper half casing 300.

The return flow paths 56 cause the process gas that has flowed through the curved flow paths 55, to flow into the impellers 4, respectively. The return flow paths 56 are each gradually increased in width while extending toward the inside in the radial direction Dr. The return flow paths 56 change the flowing direction of the process gas toward the downstream side in the axis line direction Dr, inside the diaphragm group 5 in the radial direction Dr.

The sealing device 6 suppresses leakage of the process gas from the inside to the outside of the casing 101. The sealing device 6 seals the outer peripheral surface of the rotary shaft 3 over the entire circumference. As the sealing device 6 of the present embodiment, for example, a labyrinth seal is used.

As illustrated in FIG. 1 and FIG. 2, the casing assembly 100 accommodates the rotor 2, the diaphragm group 5, and the sealing device 6. The casing assembly 100 includes the lower half casing 200, the upper half casing 300, a fixing portion 400, a seal housing holder 500, and a sealing member 600.

The lower half casing 200 is fixed to, for example, a bottom floor. The lower half casing 200 includes a part of the suction port 52 that opens downward in a vertical direction Dv. The lower half casing 200 includes a part of the discharge port 58 that opens downward in the vertical direction Dv. The lower half casing 200 is combined with the upper half casing 300 to configure the casing 101.

The casing 101 forms an exterior of the centrifugal compressor 1. The casing 101 includes a cylindrical shape. The casing 101 is formed such that a center axis thereof is coincident with the axis line O of the rotary shaft 3. The casing 101 accommodates the diaphragm group 5.

In the following, more specific configuration of the casing 101 is described with the upper half casing 300 as an example because the lower half casing 200 and the upper half casing 300 include substantially similar configuration except for installation positions.

As illustrated in FIG. 2, the upper half casing 300 includes an upper half flange surface 310 and an upper half accommodating recess 350.

The upper half flange surface 310 is a horizontal surface facing downward in the vertical direction Dv. The upper half flange surface 310 is one of division surfaces when the casing 101 is divided in a vertical direction. The upper half flange surface 310 includes a plurality of through holes 402 into which fastening bolts are respectively inserted. The through holes 402 penetrate through the upper half casing 300 upward in the vertical direction Dv from the upper half flange surface 310. The plurality of through holes 402 are provided, on the upper half flange surface 310, with intervals that do not inhibit fastening of the adjacent fastening bolts. The through holes 402 are provided at positions matched with positions of fixing holes of the lower half casing 200 when the upper half casing 300 is combined with the lower half casing 200. The upper half flange surface 310 includes a first upper half flange surface 311 and a second upper half flange surface 312.

The first upper half flange surface 311 is connected to an upper half large-diameter recess 351 described later in the upper half accommodating recess 350. The first upper half flange surface 311 is provided on each of two positions separated in a width direction Dw with the axis line O in between as viewed from above in the vertical direction Dv. The first upper half flange surface 311 is a flat surface extending long in the axis line direction Da. A flange surface similar to the first upper half flange surface 311 is provided in the lower half casing 200.

The second upper half flange surface 312 is connected to an upper bearing chamber 352 described later of the upper half accommodating recess 350. The second upper half flange surface 312 is provided on each of both sides of the first upper half flange surface 311 in the axis line direction Da. The second upper half flange surface 312 is a flat surface continuous to the first upper half flange surface 311. The second upper half flange surface 312 is disposed inward of the first upper half flange surface 311 in the width direction Dw as viewed from above in the vertical direction Dv. A flange surface similar to the second upper half flange surface 312 is provided in the lower half casing 200.

The upper half accommodating recess 350 is recessed upward in the vertical direction Dv from the upper half flange surface 310. The upper half accommodating recess 350 is a space covered with an inner surface of the upper half casing 300 as viewed from below in the vertical direction Dv. Further, an accommodating space that extends around the axis line O is provided inside the casing 101 by the upper half accommodating recess 350 and a similar recess provided in the lower half casing 200. The members such as the diaphragm group 5 and the sealing device 6 are disposed in the accommodating space. The upper half accommodating recess 350 includes the upper half large-diameter recess 351, the upper half bearing chamber 352, and an upper half step surface 353.

The upper half large-diameter recess 351 forms, together with a similar space of the lower half casing 200, the space in which the diaphragm group 5 is accommodated. The upper half large-diameter recess 351 is a space provided around the axis line O. The upper half large-diameter recess 351 extends in the axis line direction Da and is recessed from the first upper half flange surface 311. The upper half large-diameter recess 351 is provided on the inside in the width direction Dw so as to be sandwiched between the two first upper half flange surfaces 311 as viewed from below in the vertical direction Dv. The upper half large-diameter recess 351 includes a substantially rectangular shape as viewed from below in the vertical direction Dv. The upper half large-diameter recess 351 forms some of the curved flow paths 55 by the inner surface of the upper half casing 300 facing inward in the width direction Dw, except for a region provided with the flow path forming body 60.

The upper half bearing chamber 352 is a space in which the sealing device 6 is accommodated. The upper half bearing chamber 352 is adjacent to the upper half large-diameter recess 351 in the axis line direction Da and extends in the axis line direction Da. The upper half bearing chamber 352 is provided on each of both sides of the upper half large-diameter recess 351 in the axis line direction Da so as to sandwich the upper half large-diameter recess 351. The upper half bearing chamber 352 is a space that is recessed from the second upper half flange surface 312 and is provided around the axis line O. The upper half bearing chamber 352 is provided on the inside in the width direction Dw so as to be sandwiched between the two second upper half flange surfaces 312 as viewed from below in the vertical direction Dv. A size of the upper half bearing chamber 352 in the radial direction Dr is made smaller than that of the upper half large-diameter recess 351. In other words, the upper half bearing chamber 352 includes a rectangular shape smaller than that of the upper half large-diameter recess 351 as viewed from below in the vertical direction Dv.

The upper half step surface 353 is a surface extending in the radial direction Dr between the upper half large-diameter recess 351 and the upper half bearing chamber 352. The upper half step surface 353 is a part of the surface forming the upper half large-diameter recess 351. The upper half step surface 353 is directly connected to the upper half flange surface 310, and the upper half step surface 353 on one side in the axis line direction Da forms a part of the suction port 52. The upper half step surface 353 on the other side in the axis line direction Da forms a part of the discharge port 58.

The fixing portion 400 fixes the lower half casing 200 and the upper half casing 300 so as to form the accommodating space while an unillustrated lower half flange surface and the upper half flange surface 310 are in contact with each other. The fixing portion 400 of the present embodiment includes the fixing holes provided in the lower half flange surface, the through holes 402 provided in the upper half flange surface 310, and the unillustrated fastening bolts that are respectively screwed to the fixing holes while being respectively inserted into the through holes 402.

The seal housing holder 500 is provided on each of one side and the other side of the casing 101 in the axis line direction Da. The sealing device 6 is fixed inside the seal housing holder 500. The seal housing holder 500 includes a cylindrical shape around the axis line O. The rotary shaft 3 is inserted into the seal housing holder 500 in a state where the sealing device 6 is fixed inside the seal housing holder 500. The seal housing holder 500 is fixed to the lower half casing 200 and the upper half casing 300 through the sealing member 600.

The sealing member 600 seals a space between the lower half casing 200 and the seal housing holder 500 and a space between the upper half casing 300 and the seal housing holder 500. The sealing member 600 is provided on an outer peripheral surface of the seal housing holder 500. The sealing member 600 is in contact with the inner peripheral surface of the upper half bearing chamber 352 and an inner peripheral surface of a similar recess provided in the lower half casing 200. The sealing member 600 of the present embodiment is an O-shaped ring. The sealing member 600 is disposed on each of three positions separated from one another in the axis line direction Da, on the outer peripheral surface of the seal housing holder 500. One sealing member 600 is provided at each of both ends in the axis line direction Da of the outer peripheral surface of the seal housing holder 500, and one sealing member 600 is provided on outside of the center in the axis line direction Da of the outer peripheral surface of the seal housing holder 500.

In the above-described centrifugal compressor 1, the upper half casing 300 is placed on the lower half casing 200 from above in the vertical direction Dv in a state where the rotor 2 and the diaphragm group 5 are placed on the lower half casing 200. In this state, the fastening bolts are respectively inserted into the through holes 402 of the upper half casing 300, and front end parts of the fastening bolts are respectively screwed into the fixing holes of the lower half casing 200. As a result, the centrifugal compressor 1 that includes the casing assembly 100 and the rotor 2 disposed inside the casing assembly 100 is assembled.

[Effects]

Effects achieved by the centrifugal compressor 1 according to the present embodiment are described below.

When the centrifugal compressor 1 is operated, the high-pressure process gas flows to cause large pressure in the space in which the diaphragm group 5 and the like are disposed. Occurrence of the large pressure in the above-described manner may cause leakage of the process gas from the division surfaces between the lower half casing 200 and the upper half casing 300.

Further, in addition to the pressure problem, the division surfaces may be separated due to temperature rise that accompanies pressure rise of the process gas. For example, when the centrifugal compressor 1 is used for a nitric acid plant, the process gas at about 50° C. is raised to about 200° C. along with the pressure rise. Accordingly, in the casing 101, temperature difference occurs between the upstream side and the downstream side of the process gas, and thermal deformation occurs due to the temperature difference. In particular, the temperature difference becomes remarkable in the rear stage in which the degree of the pressure rise of the process gas is large.

In addition, cleaning water is injected in order to clean the inside of the centrifugal compressor 1 during operation in some cases. The casing 101 is rapidly cooled by the cleaning water supplied by water injection, and temperature distribution inside the casing 101 is unsteadily varied. As a result, steep temperature difference occurs in the thickness direction of the casing 101, and thermal deformation that causes separation occurs due to the temperature difference at and around the division surfaces. In particular, the temperature difference becomes remarkable in the rear stage in which the degree of the pressure rise of the process gas is large.

In the centrifugal compressor 1, however, the inside close to the axis line O of each of the curved flow path 55 in the last stage and the curved flow path 55 in the next-to-last stage is configured by the outer peripheral surface of the corresponding diaphragm 51, and the outside far from the axis line O is configured by the flow path 63 of the flow path forming body 60. Accordingly, the process gas or the cleaning water of the water injection that flows through these curved flow paths 55 does not come into direct contact with the casing 101 (lower half casing 200 and upper half casing 300). In other words, in the lower half casing 200 and the upper half casing 300 around the flow path forming body 60, temperature rise caused by flowing of the process gas or temperature difference caused by the cleaning water of the water injection is moderated. This makes it possible to suppress separation of the division surfaces. In addition, it is possible to moderate thermal stress that causes plastic deformation of the casing 101.

In the centrifugal compressor 1 according to the present embodiment, the curved flow paths 55 in the rear stage in which the temperature of the process gas is high, are configured by the diaphragms 51 and the flow path forming body 60 as internal components. The curved flow paths 55 in the precedent stage also may be configured by the diaphragms 51 and the flow path forming body 60, or the curved flow paths 55 in all stages from the first stage to the last stage may be configured by the diaphragms 51 and the flow path forming body 60. A guideline for determination of the positions of the curved flow paths 55 configured by the diaphragms 51 and the flow path forming body 60, includes the temperature of the process gas and a range where the water injection is performed. The water injection may be performed on all stages from the first stage to the last stage, or may be partially performed from the first stage to the middle stage or from the middle stage to the last stage.

At this time, in a case where the temperature of the process gas is used as the guideline, the curved flow path 55 in the rear stage in which the temperature of the process gas is high, in particular, in the last stage is preferably configured by the diaphragm 51 and the flow path forming body 60.

Further, in a case where the range where the water injection is performed is used as the guideline, the curved flow paths 55 within the range where the water injection is performed described above may be configured by the diaphragms 51 and the flow path forming body 60; however, the curved flow path 55 in the rear stage within the range where the water injection is performed, in particular, in the last stage is preferably configured by the diaphragm 51 and the flow path forming body 60. For example, in a case where the water injection is performed from the first stage to the middle stage, the curved flow path 55 in the middle stage is configured by the diaphragm 51 and the flow path forming body 60. Note that the range until the middle stage indicates that the cleaning water is drained in the middle so as to prevent the cleaning water from flowing through the subsequent stages. Further, even in the case where the water injection is performed from the first stage to the middle stage, the cleaning water may be supplied to the stage subsequent to the middle stage as a result. Therefore, the flow path forming body 60 may be provided in consideration of the range where the cleaning water is supplied.

The present invention does not eliminate a case where a plurality of flow path forming bodies 60 are provided based on both of the guidelines, namely, the temperature of the process gas and the range where the water injection is performed.

Further, in the present embodiment, the annular accommodating groove 301 recessed outward in the radial direction Dr is provided, in the casing 101, namely, in the upper half casing 300, corresponding to the region provided with the flow path forming body 60, and the annular flow path forming body 60 is mated with the accommodating groove 301. Accordingly, it is possible to avoid the process gas from coming into direct contact with the upper half casing 300 in the region while achieving the following effects. In other words, when diffuser diameters at the same degree are necessary for all stages, it is possible to fabricate the curved flow paths 55 on the casing 101 side in the stage not requiring the flow path forming body 60. This makes it possible to reduce costs for designing, processing, and assembling. In addition, in a case where the flow path forming body 60 is provided by changing the shapes of the diaphragms 51, it is necessary to change the shapes and the dimensions of the flow paths, which may influence hydrodynamic performance; however, such influence can be eliminated in the present embodiment. In the case of the present embodiment, the curved flow paths 55 other than the curved flow paths configured by the flow path forming body 60 are provided between the diaphragms 51 and the casing 101.

Note that the present invention encompasses that the dimensions of the diaphragms 51 in the radial direction are reduced without changing the shape of the casing 101 and the flow path forming body 60 is provided in a resultant space. In this case, however, the shapes and the dimensions of the flow paths are restricted, for example, the lengths of the diffuser flow paths 54 and the return flow paths 56 are decreased and the compression ratio is not accordingly gained. This may influence hydrodynamic performance.

Further, in the present embodiment, one flow path forming body 60 includes the two flow paths 63 and 63 which respectively correspond to the two curved flow paths 55 and 55 adjacent to each other. Accordingly, as compared with a case where two flow path forming bodies are provided corresponding to the two curved flow paths 55 and 55, it is possible to reduce the costs for designing, processing, and assembling. In this case, two flow paths 55 are described as an example; however, one flow path forming body including flow paths corresponding to three or more curved flow paths 55 may be used. Note that the present invention does not eliminate a case where the flow path forming body corresponding to only one curved flow path 55 is provided.

Further, in the centrifugal compressor 1 according to the present embodiment, the flow path forming body 60 is provided in each of the lower half casing 200 and the upper half casing 300; however, the flow path forming body 60 may be provided in only one of them.

Hereinbefore, an embodiment of the present invention has been described in detail with reference to drawings; however, the configurations and the combinations thereof in the embodiment are illustrative, and addition, omission, substitution, and other modification of the configurations may be made without departing from the scope of the present invention. Further, the present invention is not limited by the embodiment and is limited only by Claims.

The present invention can adopt means that change a thermal condition of the casing 101 to bring the temperature distribution closer to uniform, and reduces the thermal deformation to reduce leakage of the process gas from the division surfaces. This is specifically described below.

Figure 3:
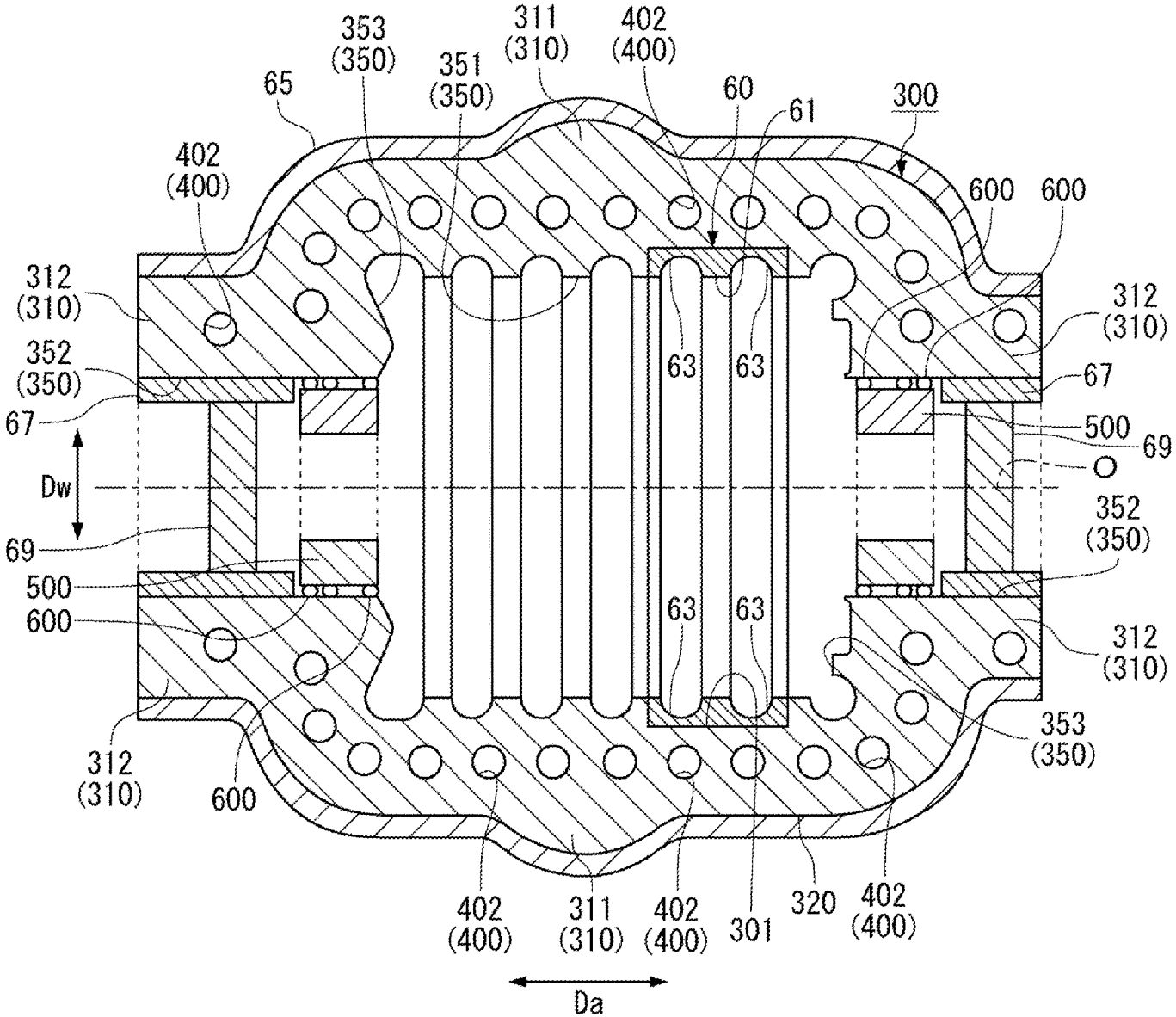
FIG. 3 is a diagram illustrating an upper half casing according to another embodiment of the present invention as viewed from below in a vertical direction.

First, as illustrated in FIG. 3, the outer peripheral surface of the casing 101 (upper half casing 300) may be covered with a heat insulation material 65 to bring the temperature distribution inside the casing 101 closer to uniform, which makes it possible to prevent separation of the flange surfaces due to thermal deformation. As the heat insulation material 65, a fiber-based heat insulation material such as glass wool and cellulose fibers, and a foamed heat insulation material such as urethane foam and phenol foam.

Further, as illustrated in FIG. 3, in a case where paired bearings 69 and 69 that support the rotary shaft 3 are provided, when the upper half bearing chambers 352 and 352 respectively accommodating the bearings 69 and 69 each include a heat shielding material 67, it is possible to limit influence of cooling by the bearings 69 and 69, to bring the temperature distribution inside the casing 101 closer to uniform, and to prevent separation of the division surfaces due to thermal deformation. Note that only the upper half bearing chambers 352 and 352 are illustrated in FIG. 3; however, the bearings 69 and 69 are held by bearing chambers provided in the lower half casing 200.

With the above-described configuration, the temperature distribution inside the casing 101 is brought closer to uniform, the temperature difference between the end parts of the rotary shaft 3 and the discharge port 58 and its surroundings is reduced, and a thermal deformation amount is reduced. This makes it possible to reduce separation of the division surfaces. Further, the temperature difference between the rotary shaft 3 and the discharge port 58 and its surroundings, and the temperature difference in the thickness direction of the casing 101 are reduced inside the casing 101. This also makes it possible to reduce thermal stress occurring on the casing 101.

Further, the centrifugal compressor 1 has been described as an example of the rotary machine in the present embodiment; however, the rotary machine is not limited thereto. For example, the rotary machine may be a supercharger or a pump.

REFERENCE SIGNS LIST

1 Centrifugal compressor
2 Rotor
3 Rotary shaft
4 Impeller
4*a* Disk
4*b* Blade
4*c* Cover
5 Diaphragm group
6 Sealing device
51 Diaphragm
52 Suction port
53 Suction flow path
54 Diffuser flow path
55 Curved flow path
56 Return flow path
57 Discharge flow path
58 Discharge port
60 Flow path forming body
61 Main body
63 Flow path
65 Heat insulation material
67 Heat shielding material
69 Bearing
100 Casing assembly
101 Casing
200 Lower half casing
300 Upper half casing
301 Accommodating groove
310 Upper half flange surface
311 First upper half flange surface
312 Second upper half flange surface
350 Upper half accommodating recess
351 Upper half large-diameter recess
352 Upper half bearing chamber
353 Upper half step surface
400 Fixing portion
402 Through hole
500 Seal housing holder
600 Sealing member

The invention claimed is:

1. A rotary machine, comprising:

a casing;

a rotor that includes a rotary shaft rotatably supported inside the casing, and a plurality of stages of impellers fixed to an outer periphery of the rotary shaft;

diaphragms respectively surrounding the impellers; and gas flow paths through which process gas to be compressed flows, the gas flow paths being provided respectively corresponding to the impellers, wherein the gas flow paths include diffuser flow paths, curved flow paths, and return flow paths, the diffuser flow paths respectively communicate from outlets of the impellers in a radially outward direction to the curved flow paths, the curved flow paths respectively communicate from outlets of the diffuser flow paths and change a flowing direction of the process gas from the radially outward direction toward a radially inward direction to the return flow paths, the return flow paths respectively communicate from outlets of the curved flow paths and cause the process gas flowing through the curved flow paths, to flow into a next stage of the impellers, the curved flow path configuring at least one of the gas flow paths is provided between the diaphragm and a flow path forming body that is provided between the diaphragm and the casing, the flow path forming body provided such as to substitute a part of the casing, the casing includes an annular accommodating groove recessed outward in the radial direction, corresponding to a region provided with the flow path forming body, and the flow path forming body includes an annular shape and is mated with the accommodating groove such that a radial extent of the curved flow path provided between the diaphragm and the flow path forming body is located inside a radial extent of the accommodating groove of the casing.

2. The rotary machine according to claim 1, wherein the flow path forming body is positioned based on one or both of temperature of the process gas and a range where water injection is performed.

3. The rotary machine according to claim 2, wherein the curved flow path configuring the gas flow path located in at least a last stage, out of the gas flow paths, is provided between the corresponding diaphragm and the flow path forming body.

4. The rotary machine according to claim 2, wherein the curved flow paths configuring the gas flow paths located in all stages within the range where the water injection is performed, out of the gas flow paths, are provided between the diaphragms and the flow path forming body.

5. The rotary machine according to claim 2, wherein the curved flow path configuring the gas flow path located in a rear stage within the range where the water injection is performed, out of the gas flow paths, is provided between the corresponding diaphragm and the flow path forming body.

6. The rotary machine according to claim 1, wherein the casing is a horizontal divisional casing including a lower half casing and an upper half casing, and the curved flow paths provided between the diaphragms and the flow path forming body are provided on one or both of the lower half casing and the upper half casing.

7. The rotary machine according to claim 1, wherein the curved flow paths other than the curved flow paths provided between the diaphragms and the flow path forming body, are provided between the diaphragms and the casing.

8. The rotary machine according to claim 1, wherein the casing is covered with a heat insulation material.

9. The rotary machine according to claim 1, wherein the casing includes paired bearings supporting the rotary shaft, and bearing chambers respectively accommodating the bearings each include a heat shielding material.

* * * * *